US006852916B1

(12) United States Patent
Burguete et al.

(10) Patent No.: US 6,852,916 B1
(45) Date of Patent: Feb. 8, 2005

(54) LUTE

(76) Inventors: Andre Burguete, Thomas-Muntzer-Platz 4, Dresden (DE), 01307; Benno Streu, Turnseestrasse 1, Freiburg im Breisgau (DE), 79102; Gunter Mark, Elsa 47, Bad Rodach (DE), 96476

( * ) Notice: Subject to any disclaimer, the term of this patent is extended or adjusted under 35 U.S.C. 154(b) by 0 days.

(21) Appl. No.: 10/069,653

(22) PCT Filed: Aug. 25, 2000

(86) PCT No.: PCT/DE00/02905

§ 371 (c)(1),
(2), (4) Date: Jul. 12, 2002

(87) PCT Pub. No.: WO01/15134

PCT Pub. Date: Mar. 1, 2001

(30) Foreign Application Priority Data

Aug. 26, 1999 (DE) ..... 199 40 486

(51) Int. Cl.[7] ..... G10D 3/00

(52) U.S. Cl. ..... 84/291; 84/293; 84/267; 84/314 R

(58) Field of Search ..... 84/291, 267, 293, 84/314 R

(56) References Cited

U.S. PATENT DOCUMENTS 375,224 A * 12/1887 Talbott ..... 84/291
1,361,182 A 12/1920 Reams, Jr. et al. ..... 84/291
3,656,295 A * 4/1972 Kaman ..... 84/267
4,079,654 A * 3/1978 Kasha ..... 84/291
4,291,606 A * 9/1981 Lepage ..... 84/291
5,952,592 A * 9/1999 Teel ..... 84/291

FOREIGN PATENT DOCUMENTS

DE G8808073.0 3/2002

OTHER PUBLICATIONS

"Leopold Widhalm und der Nürnberger Lauten–und Geigenbau im 18. Jahrhundert", by Klaus Martius, vol. 4, *Verlag Erwin Bochinsky,* 1996.
"Antonio de Torres, Ein Gitarrenbauer—Sein Leben und Werk", by Jos´´ L. Romanillos, *Verlag Erwin Bochinsky.*

* cited by examiner

*Primary Examiner*—Shih-Yung Hsieh
(74) *Attorney, Agent, or Firm*—Baker Botts LLP; Manu J. Tejwani

(57) ABSTRACT

This invention relates to a lute comprising a body-shaped sound box and a neck attached thereto. The sound box is made up of a domed rear section and a cover. The aim of the invention is to provide a lute which can meet the needs of modern concert performances and be used by contemporary guitarists, whereby the excellent sound qualities of the lute are retained and the instrument can be used in a modern-day orchestra. This is achieved by providing the cover and the string-holder with a outwardly curved shape; a surface that is devoid of any transverse beams is arranged on the underside in an approximately symmetrical position with respect to the string holder and said surface is configured as a strip-free surface or fitted with strips which are symmetrical with respect to the center axis.

14 Claims, 6 Drawing Sheets

LUTE

BACKGROUND OF THE INVENTION

The invention relates to a lute having a bulging sound box tapering to a virtual point and a neck attached to the so-called stock or upper block to one side of the point. The neck comprises a fingerboard furnished with frets. At its free end, the neck bears a peg box. The sound box consists of the vaulted back of the lute, its rim always curved outward from one side of the neck to the other and lying in a plane. The sound box comprises a face whose edge is connected to the rim of the back. The face, on its under side towards the back of the lute, is provided with spreaders or fan beams, hereinafter referred to as laths, and transverse ribs. On its top, opposed to the under side, the face is furnished with a tailpiece, connected to the third of the face centerline farthest removed from the neck and in its lengthwise extent transverse to the centerline. Between the peg box and the tailpiece, a plurality of strings are stretched. In the half of the centerline near the neck, in the region of the strings, one or more apertures are made between the upper and under side of the face.

In Claus Martius, *Leopold Widhalm und der Nürnberger Lauten-und Geigenbau im* 18. *Jh.*, a publication of the Institute for Synthetics Technology and Conservation in the Germanic National Museum, vol. 4, Verlag Erwin Bochinski 1996, we have the latest stage of development of the lute in the 18th Century. A lute, then, has a bulging sound box tapering down to a virtual point, where a neck is attached. As part of the generally known prior art, the neck comprises a fingerboard furnished with frets and bearing a peg box at its free end.

Concerning the lute dating from the 18th Century, it is known further that the sound box consists of the vaulted back of the lute, its rim always curved outwardly from one side of the neck to the other. The edge of the back lies in a plane. The back of the lute is covered with a face whose edge is connected to the rim of the back.

The face, like almost all parts of the lute, is made of wood. The direction of the grain of the face is parallel to its centerline. This means that new and old wood in the face form nearly straight stripes, substantially parallel to the centerline of the face.

The familiar lute is provided with seven transverse ribs, lying transverse to the centerline and hence in particular transverse to the grain of the wood of the face. Thus, the preponderant area of the under side of the face is provided with transverse ribs. In about a quarter of the area of the under side of the face away from the neck there are provided fan ribs. The axis of these fan ribs have—if any—a common point of intersection, located in the third of the centerline of the face furthest removed from the neck.

Specifically, an approximately common point of intersection lies in the neighborhood of a tailpiece arranged on the top of the face. In fact, this tailpiece is located in the third of the face centerline farthest removed from the neck. It is connected to the face on this centerline and in its lengthwise extent transverse to the centerline. Between the peg box and the tailpiece, several strings are stretched. The classic stringing consists of 13 strings tuned A-B-C-D-E-F-G-A-d-f-a-d'-f'. The first ten of these strings are double. Only the d' and f' strings are single.

From José L. Romanillos, *Antonio de Torres, Ein Gitarrenbauer—Sein Leben und Werk*, Verlag Erwin Bochinski, we learn of Antonio de Toffes' construction of about 1850, still used for concert guitars today. Such a guitar comprises a face and a back, connected to each other by a frame. The frame has a pronounced waist, so that both face and back follow this conformation. In the neighborhood of the waist, a transverse rib is arranged. In addition to two more transverse ribs in the part of the face near the neck, this known guitar is also provided with two oblique laths in the part distant from the neck. Between these oblique laths and the ribs in the waist area of the guitar, additional laths or so-called fan ribs are arranged, the parts designated as laths occupying only about 1/10 of the cross-sectional area of the parts referred to as ribs. About in the middle between waist and far end of the guitar, the end piece is attached to the top of the face. Between the end piece and the peg box located at its free end, six strings tuned E-A-d-g-h-e' are stretched.

The present-day guitar, developed in Spain in the middle of the 19th Century, is undoubtedly one of the most popular musical instruments of the age.

Nevertheless, for European music it represents only a stand-in for the lute.

Since the 15th Century, the lute has become one of the most important tonal implements of western musical literature. Many famed composers left works behind that had been written for the lute. But these works today can hardly or only inadequately be rendered on the guitar acting as stand-in, for which reason they have largely lapsed into oblivion.

The reason for the displacement of the lute from today's orchestras is to be found in that nearly all orchestral instruments have accomplished a definite development in the past few centuries, while the lute has not. As a result, the lute lacks volume, it is very complicated to play, has limited expressiveness and an antiquated notation.

In printed source U.S. Pat. No. 1,361,182, a stringed instrument is described that comprises a body having a substantially closed frame around an upper and an under side. However, the upper and under sides are each convexly vaulted. This instrument has no transverse ribs or laths, and the body departs from the typical lute shape, so that this instrument will yield a sound differing distinctly from that of the lute.

German Utility Design G 88 08 073.0 describes an instrument representing the structure of a guitar as described above.

The object of this invention, then, is to lend the lute a conformation such that it will meet modern concert conditions and become accessible, while retaining its outstanding tonal properties, to present-day guitarists, thus making possible a reintegration of the lute into the orchestral apparatus of today.

SUMMARY OF THE INVENTION

According to the invention, the face of the lute, including the end piece, is vaulted outward, the greatest distance of the vaulted face above the plane being at least 2 mm. In addition, on the underside of the face, a space clear of transverse ribs is provided, corresponding to a first segment, between the end piece and the part of the rim away from the neck, and a second segment adjacent to the first and of about the same size between the mutually opposed rims. Thus, the area free from transverse ribs is either at the same time a lath-free area, or provided with laths arranged in central symmetry. By virtue of the face curvature, the lute is endowed with a stability dispensing with any heavy stiffening of the face. It thus becomes possible to set this face area in vibration more readily, improving the access of sound to the instrument.

Ideally, the area on the under side of the face located below the end piece should have little if any lathing, to avoid impeding acoustic access or propagation.

In a favorable embodiment of the invention, provision is made so that the lathing, if present, consists of laths running substantially parallel to the centerline.

The laths may run at an acute angle to the direction of the centerline. What is meant here by the run of the laths is that their centerlines make at most an angle of less than 45° with the centerline.

In a possible embodiment of the invention, provision is made for the laths to run fan-shaped in such manner that their mid-length axes intersect at an imaginary point on the centerline of the face or its prolongation towards the neck.

Alternatively, it is also possible that the laths may run parallel to the centerline.

In another embodiment of the invention, an even number of laths is provided. The effect of this is to leave the centerline unlatched.

In another embodiment of the invention, an odd number of laths is provided.

Since the laths are in principle arranged symmetrically to the centerline of the face, an odd number of laths will ensure that the centerline itself is always lathed.

As odd numbers, the numbers three, five, seven and nine are especially suitable numbers of laths.

In an advantageous embodiment of the invention, provision is made for the thickness of the face, at least in the region of the area free from transverse ribs, to diminish towards the edge. This will achieve a higher fundamental component of bass sounds.

In principle, such a lathing will make possible a more uniform transmission of sound from the end piece to the face.

In still another embodiment of the invention, provision is made for the ends of the transverse ribs to rest on abutments.

The invention may also be further developed in that at least two laths run under, without contact, at least that transverse rib which lies closest to the unribbed area. This is accomplished in that the rib comprises a tunnel-shaped recess at the intersection between rib and lath. This avoids contact between lath and rib, and affords passage of sound by way of the laths also into that part of the area which is provided with ribs.

In still another embodiment of the invention, provision is made for the fingerboard to be prolonged by a face segment on the face. On this segment, the arrangement of the frets is continued. Owing to this arrangement, it is possible for the higher strings to be playable with higher tones as well.

In this embodiment, it is expedient to reinforce the face in the neighborhood of the face segment with a piece of hardwood on its under side. For in the first place, this enhances the mechanical stability of the face in this area, which is expedient, since playing of the strings will exert a not inconsiderable pressure on this part of the face. In the second place, it also strengthens the acoustic access of the strings by way of the face, since just when the higher strings are played with higher tone, the oscillatory bulk of the strings and hence their volume is very low, especially if the face is yielding in this segment.

In yet another embodiment of the invention, provision is made for eight strings to be stretched on the lute, with tuning C-D-E-A-d-g-h-e'. With such a stringing, it becomes possible to play all guitar music since 1800, as well as modern music. If in addition, the g-string is turned down a half-step to fis, it becomes possible also to play all the lute music from 1450 to 1630.

Alternatively to this stringing, it is possible to string the lute with fifteen single strings, tuned G-A-B-C-D-E-F-G-A-B-d-f-a-d'-f', or else G-A-B-C-D-E-F-G-A-B-d-f-a-d'-g'. Such a stringing yields the possibility of playing the entire lute music in the period between 1630 and 1800, parts of the guitar repertory, music of the 19th and 20th Centuries, parts of the lute music repertoires from 1450 to 1630, as well as present-day compositions.

The invention will now be illustrated in more detail in terms of an embodiment by way of example.

DESCRIPTION OF THE INVENTION

Figure 1:
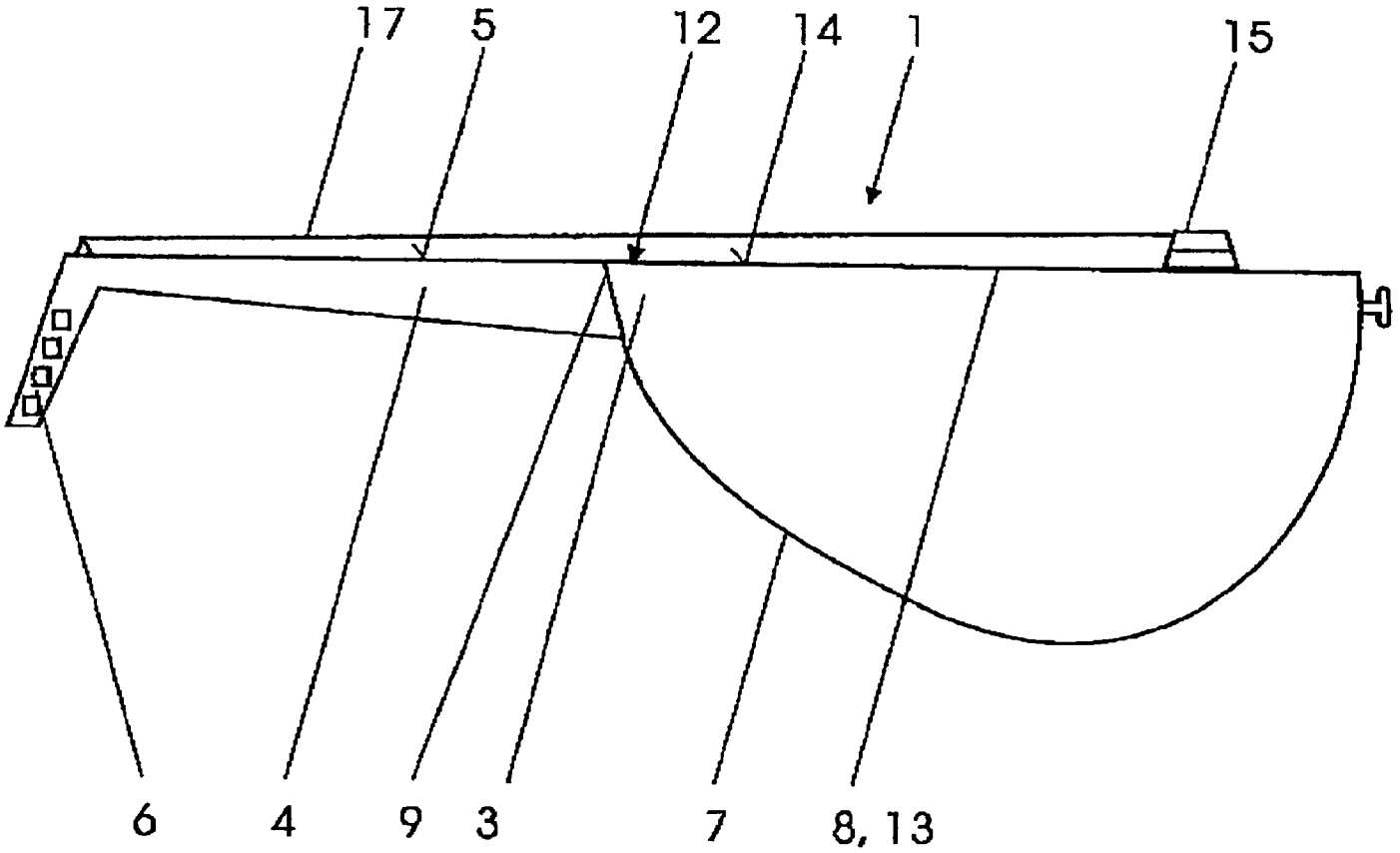
FIG. 1 shows a side view of a lute according to an embodiment of the invention, FIGS. 2 and 5 each show a top view of the under side of the face of a lute according to a respective embodiment of the invention.
Figure 2:
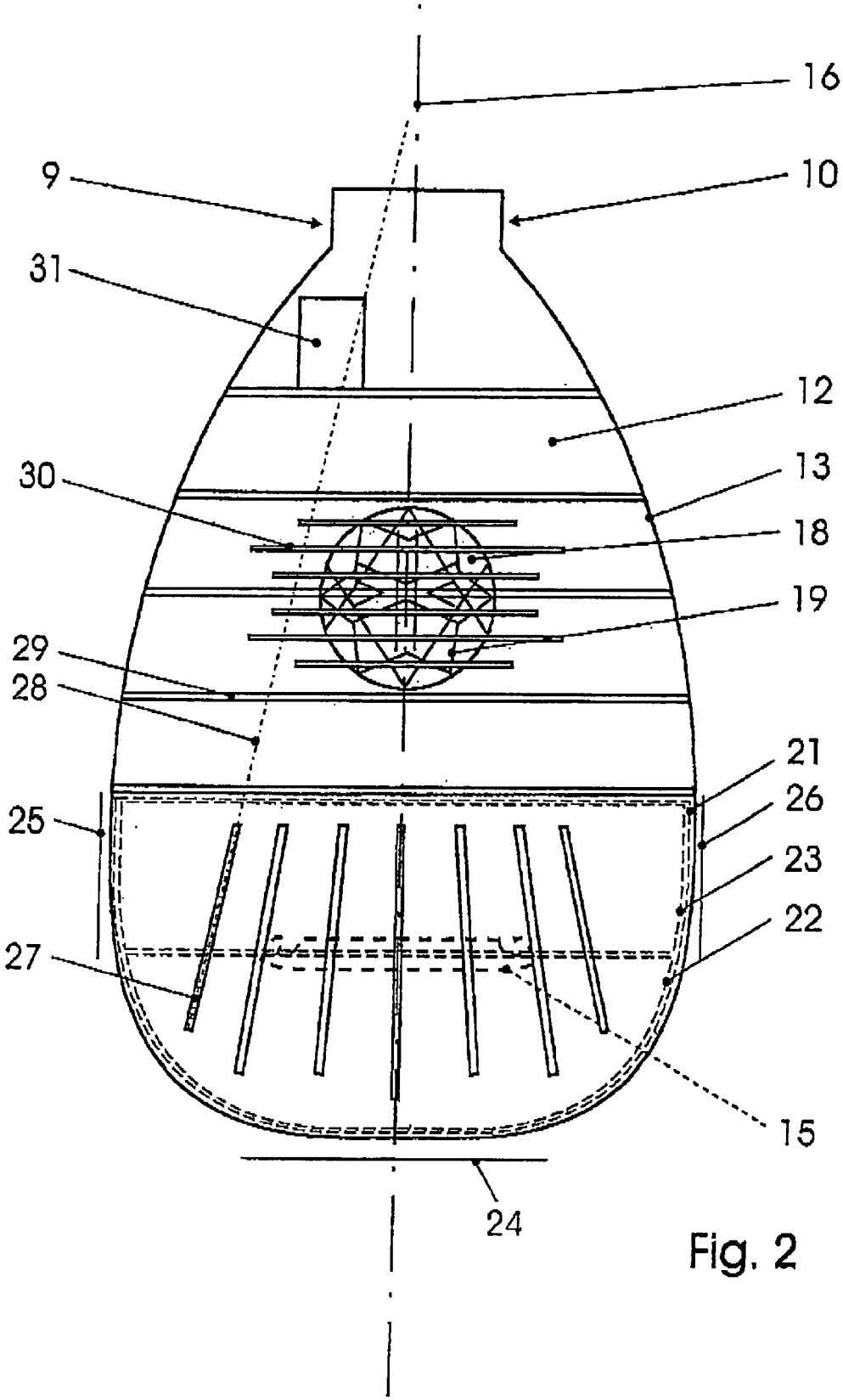

As shown in the drawings (FIGS. 1–7), the lute 1 comprises a bulging sound box 2. This is shaped so that it tapers down to a virtual tip 3. At the tip 3, a neck 4 is attached. This neck 4 comprises a fingerboard 5, provided with frets 33. At its free end, the neck 4 bears a peg box 6.

The sound box 2 itself consists of a vaulted lute back 7. The rim 8 of the back 7 is always curved outward from one side 9 of the neck 4 and the other side 10. Also, the rim 9 lies on a plane, indicated by reference numeral 11 in FIG. 3. Further, the sound box 2 consists of a face 12 whose edge 13 is connected to the rim 8 of the back 7.

On its top 14, the face 12 is provided with an end piece 15. The end piece 15 is arranged on a centerline 16 of the face 12, to wit, in its lengthwise extent transverse to the centerline 16. In this position, the end piece 15 is connected to the face 12, for example by means of a bonded connection.

Between the peg box 6 and the end piece 15, several strings 17 are stretched. On the neck half of the centerline 16, in the region of the strings 17, an aperture 18 is made in the face 12, closed with a rose 19 in such manner as to form numerous small openings.

Figure 3:
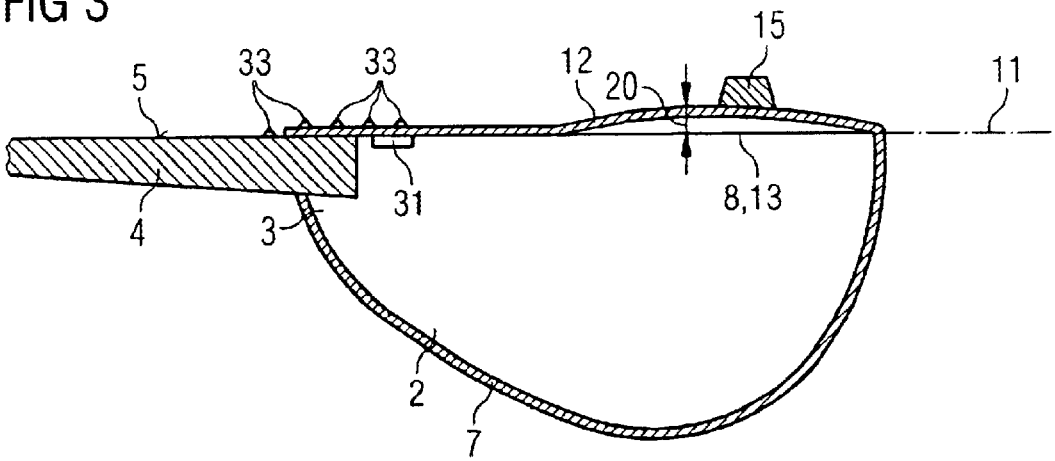
FIG. 3 shows a longitudinal section of the lute according to an embodiment of the invention.
Figure 4:
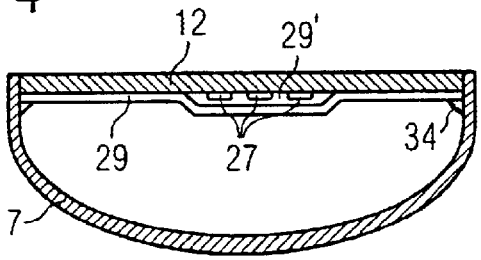
FIG. 4 shows another longitudinal section of the lute according to an embodiment of the invention. The longitudinal section is taken along a transverse rib of the lute shown in FIG. 2.

As may be seen especially in FIG. 3, the face 12 including the endpiece 15 is vaulted over a camber 20. This camber, in the embodiment of this example, amounts to 2 mm or more.

Figure 6:
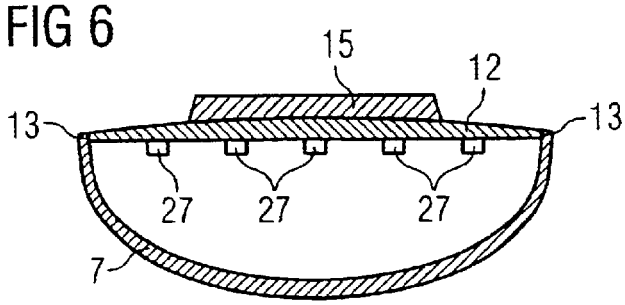
FIG. 6 shows yet another longitudinal section of the lute according to an embodiment of the invention. The longitudinal section is taken along line VI—VI in FIG. 5.
Figure 5:
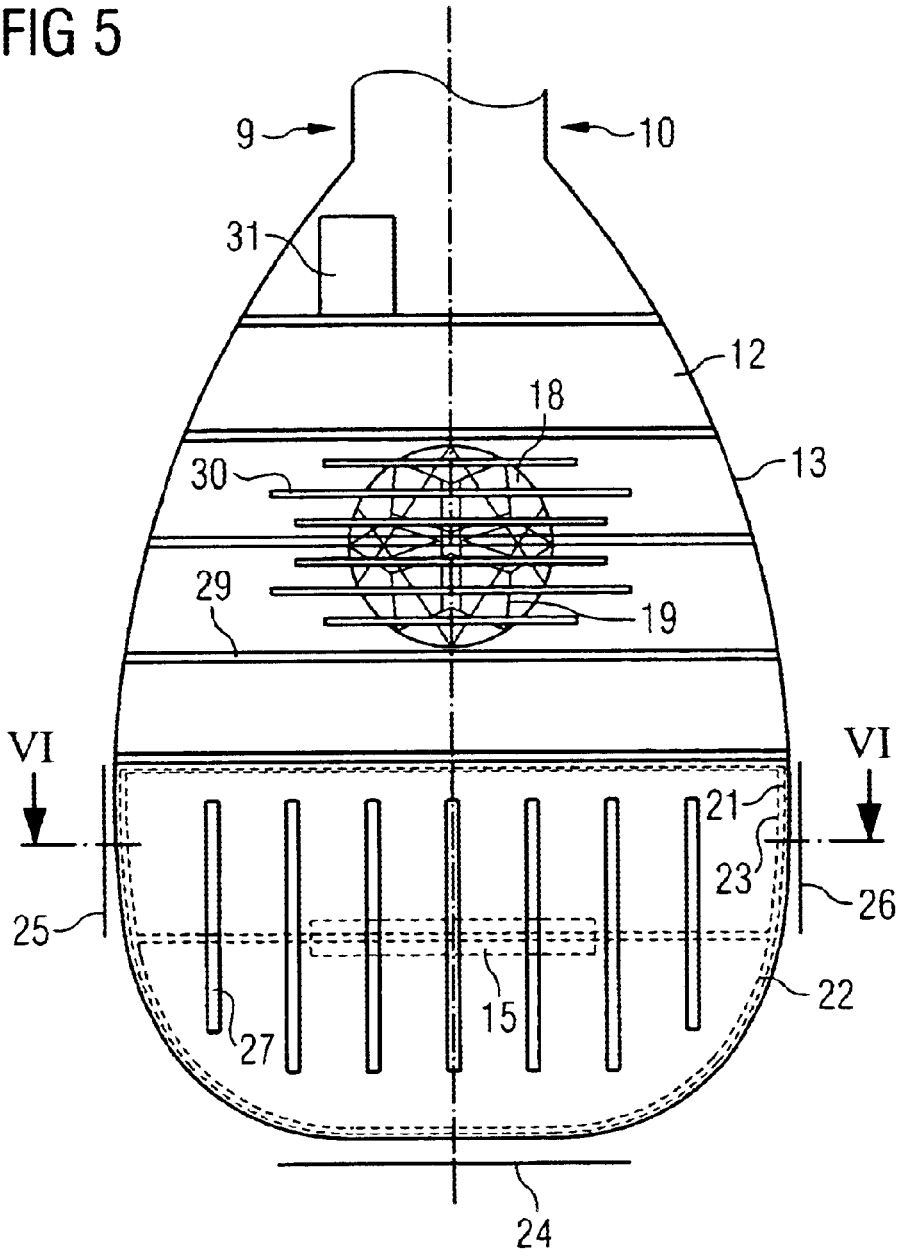
Figure 7:
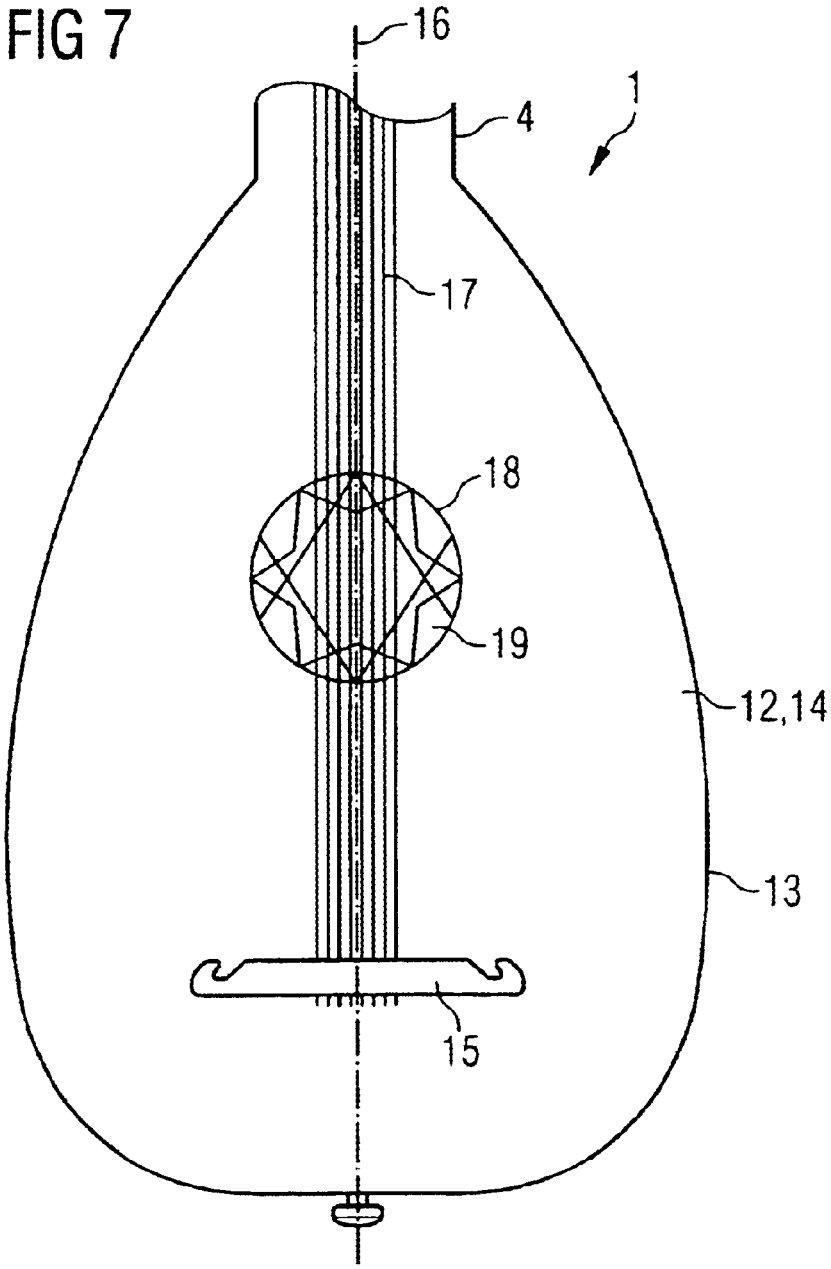
FIGS. 7 and 8 each show a stringed lute according to a respective embodiment of the invention.
Figure 8:
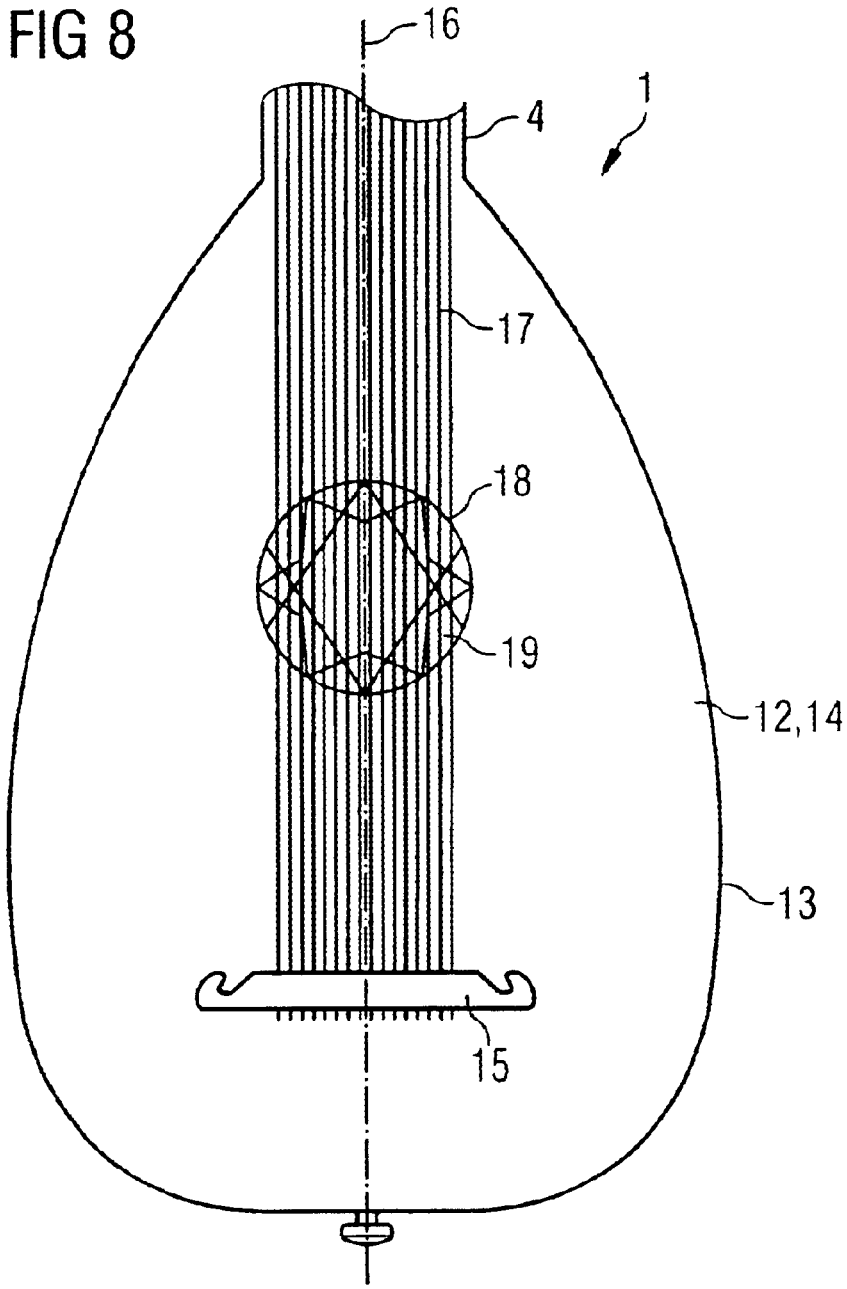

On the underside of the face 12, an area 21 free from transverse ribs is provided. The thickness of face 12 at least in this area 21 may be tapered or reduced toward rim 13 (FIG. 6). This ribless area 21 consists of first part 22 and a second part 23, arranged on opposite sides of end piece 15.

The two parts may be fabricated either as a single piece of material or as multiple pieces as may be convenient in known fabrication arts for shaping face 12 to vault over camber 20. The first part extends between the end piece 15 and the end 24 of the rim 13 away from the neck. The second part 23 borders on the first part 22 and is about the same centerline length as the first part 22. The second part extends between mutually opposed edge portions 25 and 26. In one arrangement (FIG. 4) at least two laths 27 run under at least one transverse ribs (e.g., rib 29) which lie closest to unribbed area 21 without contact with the transverse rib. By this arrangement a tunnel-shaped recess 29' is formed at the intersection between rib 29 and laths 27. This arrangement of avoiding contact between laths 27 and rib 29, affords passage of sound by way of the lathes also in that part of the area, which is provided with ribs. In the arrangement illustrated in FIG. 4, the ends of rib 29 rest on abutments 34 proximate to rim 8 of back 7.

On the area 21 free from ribs, laths 27 are arranged with central symmetry. Their mid-length axes 28 intersect at an imaginary point on the prolongation of the centerline 16 towards the neck 4.

All told, seven laths 27 are provided in the illustrated embodiment, by way of example. However, an even number of laths 27 is also possible. In the remaining area of the under side of the face, five transverse ribs 29 are arranged. The rose 19 is secured against being pushed in by small safety ribs 30.

The fingerboard 5 is prolonged by a face segment on the face 12. The face segment is fretted. As may be seen in FIG. 2 and FIG. 3, the face 12 is reinforced under the face segment on its under side with a piece of hardwood 31.

While there have been described what are believed to be the preferred embodiments of the invention those skilled in the art will recognize that other changes and modifications may be made thereto without departing from the spirit of the invention, and it is intended to claim all such changes and modifications as fall within the true scope of the invention.

What is claimed is:

1. A lute comprising a neck, a bulging sound box tapering down to a virtual point and attached to said neck at said virtual point, a peg box at an end of said neck remote from said sound box, and strings stretched between said peg box and an end piece, said sound box including a vaulted back having a planar rim that is curved outwardly from one side of said neck in a continuous curve to the other side of said neck and a face having a longitudinal centerline and connected to said rim of said back, said face including transverse ribs on an inside surface and said end piece mounted on an outside surface in a longitudinal portion thereof corresponding to a longitudinal third of said face remote from said neck, said face having at least one aperture between said inside and outside surfaces in a longitudinal half thereof nearest said neck, wherein at least a portion of said face, including said end piece, is vaulted outward from said planar rim by at least 2 mm., wherein said face includes an area at a longitudinal end thereof remote from said neck which has a longitudinal length of approximately twice a longitudinal distance between said end piece and said remote longitudinal end of said face, and wherein said area is devoid of transverse ribs.

2. A lute as specified in claim 1 wherein said area of said face includes laths extending in a generally longitudinal direction and arranged symmetrically about said longitudinal centerline.

3. A lute according to claim 2 wherein said laths are arranged at acute angles with respect to said centerline.

4. A lute according to claim 2 wherein the laths are in a fan configuration having central axes intersect at an imaginary point on said centerline of the face.

5. A lute according to claim 2 wherein the laths run parallel to said centerline.

6. A lute according to claim 2 wherein an even number of laths is provided.

7. A lute according to claim 2 wherein an odd number of laths is provided.

8. A lute according to claim 2 wherein at least two of said laths extend below at least one transverse rib which lies closest to the rib-free area, wherein said at least one transverse rib comprises a tunnel-shaped recess through which said laths pass without contact between said laths and said transverse ribs.

9. A lute according to claim 2 wherein said neck includes a fingerboard having frets and wherein said fingerboard and said frets extend onto a segment of said.

10. A lute according to claim 9 wherein said face is reinforced on its inside with a piece of hardwood in the region of said face segment.

11. A lute according to claim 1 wherein said face has a thickness which diminishes toward said rim at least in area devoid of transverse ribs.

12. A lute according to claim 1 wherein said transverse ribs have ends which rest on abutments proximate to said planar rim.

13. A lute according to claim 1 wherein eight strings (17) are strung, said strings being tuned C-D-E-A-d-g-h-e'.

14. A lute according to claim 1 wherein fifteen single strings are strung, said strings being tuned G-A-B-C-D-E-F-G-A-B-d-f-a-d'-f', or G-A-B-C-D-E-F-G-A-B-d-f-a-d'-g'.

* * * * *